US005514471A

United States Patent [19]

Okano et al.

[11] Patent Number: 5,514,471

[45] Date of Patent: May 7, 1996

[54] HIGH-STRENGTH POLYAMIDE FIBER

[75] Inventors: Ryoji Okano; Isoo Saito; Hideo Nagahara, all of Okazaki; Michikane Tuduki, Aichi, all of Japan

[73] Assignee: Toray Industries, Inc., Japan

[21] Appl. No.: 318,847

[22] PCT Filed: Feb. 23, 1994

[86] PCT No.: PCT/JP94/00281

§ 371 Date: Oct. 24, 1994

§ 102(e) Date: Oct. 24, 1994

[87] PCT Pub. No.: WO94/19517

PCT Pub. Date: Sep. 1, 1994

[30] Foreign Application Priority Data

Feb. 23, 1993 [JP] Japan ..... 5-033366
Apr. 15, 1993 [JP] Japan ..... 5-088616

[51] Int. Cl.[6] ..... D02G 3/00

[52] U.S. Cl. ..... 428/364; 428/395

[58] Field of Search ..... 428/364, 395

[56] References Cited

U.S. PATENT DOCUMENTS 4,542,063 9/1985 Tanji et al. ..... 428/364
4,732,720 3/1988 Tanji et al. ..... 264/101
4,987,030 1/1991 Saito et al. ..... 428/373
5,302,452 4/1994 Kai et al. ..... 428/364
5,341,632 8/1994 Jung et al. ..... 57/207
5,405,697 4/1995 Chaubet et al. ..... 428/364

FOREIGN PATENT DOCUMENTS 62-110910 5/1987 Japan .
63-53296 10/1988 Japan .
43469 1/1992 Japan .

*Primary Examiner*—N. Edwards
*Attorney, Agent, or Firm*—Austin R. Miller

[57] ABSTRACT

To provide a polyamide fiber such as polyhexamethylene adipamide fiber having high tenacity and excellent tenacity retention after vulcanization and GY fatigue life. This fiber is a high tenacity polyamide fiber, preferably a polyhexamethylene adipamide fiber comprising at least 95% by mole of hexamethylene adipamide units and having a sulfuric acid relative viscosity of at least 3.0, said polyamide fiber satisfying the requirements: (a) differential birefringence $\delta\Delta n \geqq -5\times10^{-3}$ to $0\times10^{-3}$, (b) long period (Dm) in the direction of fiber axis: Dm≧105 A, and long period (De) in the radial direction of fiber: De=90 to 130 A, (c) main dispersion peak temperature (Tα) in mechanical loss tangent (tanδ) curve as obtained by viscoelastic measurement: Tα≧125° C., and preferably further satisfying the requirements: (d) birefringence $\Delta n \geqq 60\times10^{-3}$, (e) crystal orientation function fc≧0.88, and (f) amorphous orientation function fa=0.70 to 0.85.

5 Claims, No Drawings

HIGH-STRENGTH POLYAMIDE FIBER

TECHNICAL FIELD

This invention relates to a high-tenacity polyamide fiber. More particularly, it relates to a high-tenacity polyamide fiber which is characterized as, when it is embedded in rubber as a reinforcing fiber and the rubber is vulcanized, exhibiting tenacity reduction only to a minor extent and yielding a vulcanized cord having a high tenacity.

BACKGROUND ART

Polyamide fibers have good toughness, adhesion, fatigue resistance and other properties, and are widely used as industrial materials. Of polyamide fibers, a polyhexamethylene adipamide fiber is especially suitable for products which are used under severe conditions or for which a high quality is required. Excellent dimensional stability to high temperature and thermal resistance of this fiber is utilized in the step of processing the fiber for the manufacture of the products.

It is always required that industrial products are lightweight and thus it is important that the amount of reinforcing fibers contained in the industrial products is minimized without substantial reduction of the reinforcing performance. For satisfying this requirement, fibers having a higher tenacity have been eagerly desired and many attempts of developing high-tenacity fibers have heretofore been made. With regard to polyamide fibers, proposals of making high-tenacity polyamide fibers were made, for example, in Japanese Unexamined Patent Application No. 1- 168913 and Japanese Unexamined Patent Publication No. 3- 241007.

Namely, a high-tenacity polyhexamethylene adipamide fiber having a special structure defined by specific fiber structural properties is described in Japanese Unexamined Patent Application No. 1-168913. This fiber is characterized by the following features (a) through (f) as compared with conventional polyhexamethylene adipamide fibers:

(a) the crystal orientation function is the same or higher, (b) the amorphous orientation fuction is higher, (c) the long period in the direction of the fiber axis is the same, (d) the long period in the direction perpendicular to the fiber axis is larger, (e) the main dispersion temperature of a mechanical loss tangent curve as obtained by a dynamic viscoelastic measurement is lower, and (f) the DSC melting point as measured by a Zep method is higher and the perfection of crystal is higher.

In other words, the high-tenacity polyhexamethylene adipamide fiber has a fiber structure capable of developing a high tenacity, i.e., features (a) and (b), as well as a fiber structure capable of developing stability against mechanical functions, i.e., features (d), (e) and (f). More practically, this fiber has a high-tenacity, a good dimensional stability to high temperature, a good tenacity-maintenance after vulcanization and a good fatigue resistance.

The above-mentioned high-tenacity polyhexamethylene adipamide fiber is made by a process characterized by the combination of a spinning at a high rate and a heat drawing at a relatively low rate. Namely, a spinning at a high rate is employed for developing the features (d), (e) and (f) and a heat drawing at a relatively low rate is employed for developing the features (a), (b) and (c). By a high speed spinning, a stable structure can be easily obtained but a high-tenacity structure is difficult to obtain. This problem is solved by combining the heat drawing at a relatively low rate with the high speed spinning in the process.

The above-mentioned high-tenacity polyhexamethylene adipamide fiber has a high tenacity, e.g., 12.5 g/d as specifically described in the working examples, but has a very low elongation, e.g., 12.0%. Further, the excellent toughness inherently possessed by a polyhexamethylene adipamide fiber is lowered in this fiber.

In Japanese Unexamined Patent Publication No. 3-241007, a polyamide fiber having a low shrinkage, a high modulus and a very high toughness, and a process for making the same are described. This polyamide fiber is characterized by the following structural features (a) through (h):

(a) the crystalline perfection index is larger than about 73, (b) the long-period interplanar spacing is larger than about 100 angstrom, (c) the long-period intensity (LPI) is larger than 1.0, (d) the apparent crystallite size (ACS) is larger than about 55 angstrom, (e) the density is larger than 1,143, (f) the birefringence is larger than about 0.06, (g) the differential birefringence ($\Delta_{90\text{-}00}$) is positive, and (h) the crystalline orientation angle is larger than 10°.

The polyamide fiber has a toughness of at least about 11.0 g/d, a dry heat shrinkage at 160° C. of at least 6.5%, a modulus of at least about 35 g/d and a sound-wave modulus of at least 90 g/d.

This polyamide fiber is made by a process wherein a heat drawing is carried out under conditions such that the fiber temperature is at least 185° C. and the residence time is about 0.05 to about 1 second, and then the heat-drawn fiber is subjected to a heat relaxation treatment under conditions such that the fiber temperature is at least 185° C. and the residence time is specific. This process is characterized by a very long heat drawing time and a very long heat relaxation time, as compared with conventional processes for making polyamide fibers, especially a direct-spinning-drawing process which is recently a most typical process for making polyamide fibers.

More specifically, the above-mentioned polyamide fiber is made by a process wherein a completely drawn nylon 66 fiber is further subjected to drawing and heat-treatment in examples 1 to 4 and 6, or a process wherein an undrawn fiber is once wound up and then the fiber is subjected to a heat drawing and a heat-treatment. This process is not concerned with a direct spinning-drawing process wherein spinning, heat-drawing and heat-treatment are carried out in a completely continuous manner. This fact would be seen from the properties of the resulting nylon 66 fibers.

The nylon 66 fiber obtained by the process described in Japanese Unexamined Patent Publication No. 3-241007 has been subjected to a heat treatment under severe conditions and therefore is a high-tenacity fiber having a high density, a high crystalline completeness index and a high apparent crystallite size. However, the excellent toughness inherently possessed by a nylon 66 fiber is lowered in this nylon 66 fiber.

To impart a durability against the deterioration due to heat, light, oxygen and the other factors, antioxidants including copper compounds are incorporated in a nylon 66 fiber. The incorporated copper compounds are liable to be partially thermally decomposed in the polymerization step and the melt-spinning step, whereby part of the copper compounds are converted to compounds which are insoluble in the polymer, namely, converted to contaminative aggregate particles. It is important to uniformly disperse the copper compounds in the polymer (i.e., to avoid the formation of portions wherein the compounds are present in a high concentration) and to minimize the thermal history of the copper compounds for preventing the thermal decomposition of the antioxidants including the copper compounds.

It is advantageous in view of a uniform dispersion that copper compounds are incorporated in the polymerization step as conventionally carried out, but a problem arises in that contaminative aggregate particles are undesirably formed by the fact that the copper compounds are subject to thermal decomposition due to the large thermal history in the polymerization step. Where a master polymer in the form of chips having incorporated therein a salient amount of a copper compound is prepared and, immediately before the melt-spinning, the master polymer is incorporated with a polymer having not incorporated therein a copper compound, the master polymer containing the copper compound in a high concentration is heated in the pelletizing step whereby a salient amount of decomposed products of the copper compound are inevitably produced. Where a powdery copper compound is incorporated with polymer chips, it is difficult to uniformly disperse the copper compound or once-adhered copper compound is occasionally come off from the chips, portions containing the copper compound in a high concentration are formed in the resulting fiber.

DISCLOSURE OF THE INVENTION

An object of the present invention is to obviate the above-mentioned problems of the prior art and to provide a polyamide fiber having improved properties, especially a high tenacity, a high elongation and a high toughness.

Another object of the present invention is to provide a high-tenacity polyhexamethylene adipamide fiber which is characterized as, when it is embedded in rubber as a reinforcing fiber and the rubber is vulcanized, exhibiting tenacity reduction only to a minor extent and yielding a vulcanized cord having a high tenacity.

Still another object of the present invention is to provide a polyamide fiber characterized by a combination of a specific fine structure, a reduced content of contaminative aggregate particles and a treating agent applied to the fiber surface.

A further object of the present invention is to provide a polyamide fiber which is capable of being made by an industrially advantageous direct spinning-drawing process.

The high-tenacity polyamide fiber of the present invention has a fine structure distinguishable from those of the conventional polyamide fibers, and has a high tenacity, a relatively large elongation and a high toughness. This polyamide fiber has a practically acceptable toughness and is capable of being made at an enhanced efficiency by an industrially advantageous spinning-drawing process.

The high-tenacity polyamide fiber of the present invention is preferably composed of polyhexamethylene adipamide or poly-ε-caproamide. An especially preferable polyamide fiber of the present invention for achieving the above-mentioned objects is a polyhexamethylene adipamide fiber comprised of at least 95% by mole of hexamethylene adipamide units and having a relative viscosity to sulfuric acid of at least 3.0 and satisfying the following structural properties:

(a) the differential birefringence $\delta\Delta n$ as defined by the following equation $\delta\Delta n=\Delta n_s-\Delta n_c$ is in the range of $-5\times10^{-3}$ to $0\times10^{-3}$, where $\Delta n_s$ is birefringence at a distance of 0.9 of the distance spanning from the center to the surface of the fiber, and $\Delta n_c$ is birefringence at the center of the fiber;

(b) $\Delta n_c$ long period (Dm) in the direction of the fiber axis and the long period (De) in the direction perpendicular to the fiber axis satisfy the following formulae:

$Dm \geqq 105$ angstrom, and $De=90-130$ angstrom;

(c) the main dispersion peak temperature ($T\alpha$) in a mechanical loss tangent ($\tan\delta$) curve as obtained by a dynamic viscoelastic measurement is:

$$T\alpha \geqq 125°\ C.,$$

(d) the birefringence (An) is:

$$\Delta n \geqq 60\times10^{-3}$$

(e) the crystal orientation function (fc) is:

$$fc \geqq 0.88,$$

and (f) the amorphous orientation function (fa) is:

$$fa=0.70 \text{ to } 0.85$$

In another aspect of the present invention, there is provided a high-tenacity polyamide fiber characterized in that the content of copper in the fiber is 30 to 150 ppm, and that the number of contaminative aggregate particles is not more than 80 in 1.0 mg. of the fiber, which particles contain copper at a concentration of at least 50 times of the copper content in the fiber and which particles have a size corresponding to at least 1/10 of the diameter of the single fiber, as measured along the fiber length, and/or a size corresponding to at least 1/25 of the diameter of the single fiber, as measured in the direction of the fiber diameter.

The high-tenacity polyamide fiber of the present invention has a strength of at least 11.0 g/d, a breaking elongation of at least 16% and a shrinkage in boiling water of not larger than 4.0%.

In still another aspect of the present invention, there is provided a high-tenacity polyamide fiber having applied thereto a treating agent comprising the following components (i), (ii) and (iii):

(i) 50 to 80% by weight, based on the total weight of the treating agent, of a diester compound, (ii) 0.3 to 10% by weight, based on the total weight of the treating agent, of a sodium salt of a phosphated product of an ethylene oxide-added (n=1 to 7) branched alcohol having 8 to 26 carbon atoms, and (iii) 10 to 40% by weight, based on the total weight of the treating agent, of a nonionic surfactant obtained by the reaction of an addition product of ethylene oxide to a polyhydric alcohol, with a monocarboxylic acid and a dicarboxylic acid.

The properties of the polyamide fiber of the present invention are determined as follows.

(A) Birefringence ($\Delta n$)

Birefringence is determined by a polarization microscope ("POH type" supplied by Nikon Corporation) according to the Berek compensator method using a white light as the light source.

(B) Differential birefringence ($\delta\Delta n=\Delta n_s-\Delta n_c$)

Birefringences ($\Delta n_s$ and $\Delta n_c$) are measured according to the interference band method using a transmission interference microscope supplied by Karl-Zeis Jena, where ns is birefringence at a distance of 0.9 of the distance spanning from the center to the surface of the fiber and $\Delta nc$ is birefringence at the center of the fiber. Differential birefringence ($\delta\Delta n$) is calculated by the equation:

$$\delta\Delta n=\Delta n_s-\Delta n_c$$

(C) Crystal orientation function (fc)

The determination is made by using an X-ray generating apparatus (4036A2 type supplied by Rigaku Electric Co.) using CuK$\alpha$ (Ni filter) at a power output of 35 kV, 15 mA and a slit of 2mm diameter. The (100) plane as observed in the vicinity of $2\theta=20.6°$ is scanned in the circumferential direction to determine a half-value width H° of the intensity distribution. Crystal orientation function (fc) is calculated by the equation:

$$fc=(180°-H°)/180°$$

(D) Amorphous orientation function (fa)

Birefringence ($\Delta n$) and crystal orientation function (fc) are determined as mentioned above. Degree of crystallization (X) is calculated from density ($\sigma g/cm^3$) of the fiber. Amorphous orientation function (fa) is calculated according to the following equation described in R. S. Stein et al, J. Polymer Sci., 21, 381 (1956):

$$\Delta=X\,fc\,\Delta°c+(1-X)\,fa\,\Delta°a$$

where $\Delta$ is birefringence,

X is degree of crystallization, fc is crystal orientation function, fa is amorphous orientation function, $\Delta°c$ is intrinsic birefringence of the crystalline region, A°a is intrinsic birefringence of the amorphous region (both $\Delta°c$ and $\Delta°a$ are 0.73).

(E) Long period (Dm) in the direction of the fiber axis and long period (De) in the direction perpendicular to the fiber axis)

The determination is made by a small-angle X-ray generating apparatus (RU2000 type supplied by Rigaku Electric Co.) using CuK$\alpha$ (Ni filter) at a power output of 50 kV, 150 mA and a slit of 1 mm diameter. A small-angle X-ray scattering photograph is taken at a camera radius of 400 mm and an exposure time of 60 minutes by using a Kodak DEF-5 film.

The long periods are determined from the distance "r" in the small-angle X-ray scattering photograph according to the Bragg's formula:

$$J=\lambda/2\sin([\tan^{-1}(r/R)]/2)$$

where R is camera radius, $\lambda$ is wavelength of X-ray, and J is long periods. The polyamide fiber of the present invention exhibits a laminar four-points scattering, and therefore, the long period (Jm) as measured according to the definition described in L. E. Alexander (editorial supervisor: Sakurada, translators: Hamada & Kajii), X-Rays to High Polymers, the second volume, chapter 5, published by Kagaku Dojin (1973) is regarded as the long period (Dm in angstrom) used herein. The long period (Je) as determined from the distance (re) between the spots is regarded as the long period (De in angstrom) used herein.

(F) Main dispersion peak temperature (T$\alpha$) in a mechanical loss tangent (tan$\delta$) curve as obtained by a dynamic viscoelastic measurement The dynamic viscoelastic measurement is conducted in an air atmosphere maintained at 23° C. and 50% R.H. by using "Vibron DDV-11" (supplied by Orientec Co.) at a vibration frequency of 11 OHZ and a temperature elevation rate of 3° C./min.

(G) Tensile strength (T/D), elongation (E) and intermediate elongation (ME)

The measurement is carried out according to JIS L- 1017, 7.5 by using a tensile tester "Tensilon UTL-4L" supplied by Orientec Co.

Namely, a sample having a length of 25 cm is conditioned under standard conditions comprising a temperature of 20° C. and a humidity of 65 % RH. By using the tensile tester, the sample is drawn at a drawing speed of 30+2 cm/min to obtain a load-elongation curve. When the sample breaks, the load (SD g) and the elongation (E % ) are measured from the load-elongation curve. The tensile strength (g/d) is calculated from the following equation:

$$\text{Tensile strength (g/d)}=SD/D$$

wherein SD is the load at break and D is fineness in denier of the sample.

The intermediate elongation (ME) is an elongation as obtained at a load of (5.36×D×n) / (2×1,000) kg from the load-elongation curve, where D is fineness (denier) of single fiber and n is number of single fibers to be combined into a yarn.

(H) Boiling water shrinkage ($\Delta S^w$)

The measurement is carried out according to JIS L- 1017, 7.14.

A sample is conditioned under standard conditions comprising a temperature of 20° C. and a humidity of 65 % RH. One end of the sample is fixed and, when an initial load in grams corresponding to 1/20 of the fineness in denier is applied to the other end of the sample, the length (L ram) of the sample is measured. The sample in an unloaded state is dipped in boiling water for 30 minutes, and then dried. The dried sample is conditioned under the same standard conditions as those mentioned above for at least 3 hours. The same load as the initial load is applied and the length (L' mm) of the sample is measured. The boiling water shrinkage is calculated from the following equation:

$$\text{Boiling water shrinkage (\%)}=[(L-L')/L]\times100$$

(I) Dry heat shrinkage ($\Delta S_n$)

The measurement is carried out according to JIS L- 1017, 7.10.2B at a temperature of 177° C.

A sample is conditioned under standard conditions comprising a temperature of 20° C. and a humidity of 65 % RH. One end of the sample is fixed and, when an initial load in grams corresponding to 1/20 of the fineness in denier is applied to the other end of the sample, the length (L mm) of the sample is measured. The sample in an unloaded state is dried in a dryer maintained at a temperature of 177° C. for 30 minutes. The dried sample is conditioned under the same standard conditions as those mentioned above for at least 30 minutes. The same load as the initial load is applied and the length (L' mm) of the sample is measured. The dry heat shrinkage is calculated from the following equation:

$$\text{Dry heat shrinkage (\%)}=[(L-L')/L]\times100$$

(J) Density ($\rho$)

The density is measured by a density gradient tube method using toluene as light liquid and carbon tetrachloride as heavy liquid at a temperature of 25° C.

(K) Number of contaminative aggregate particles

The number of contaminative aggregate particles in the filament length of 180 mm are counted by using an optical microscope, which particles have a size corresponding to at least 1/10 of the diameter of the single fiber, as measured along the fiber length, and/or a size corresponding to at least 1/25 of the diameter of the single fiber, as measured in the direction of the fiber diameter. The number of contaminative aggregate particles is expressed in term of number per 1.0 mg of the fiber.

(L) GY fatigue endurance

The measurement is carried out according to JIS L- 1017, 3.2.2.1A.

(M) Tenacity retention after vulcanization

Dipped cords are arranged in parallel on an unvulcanized rubber rubber sheet and another unvulcanized rubber sheet is placed on the arranged dipped cords. The assembly of the unvulcanized rubber sheets and the dipped cords is set in a mold and is vulcanized by using a heat-pressing machine maintained at 175° C. for 30 minutes. Then the mold is removed from the heat-pressing machine and immediately cooled with water whereby the cords are allowed to abruptly shrink in a spontaneous manner. Then the cords are separated from the rubber sheets and allowed to stand in a temperature- and humidity-controlled chamber maintained at 20° C. and 65% R.H. for at least 24 hours. Thereafter the tenacity is measured. The tenacity retention after vulcanization is expressed by the ratio (%) of the tenacity as measured after vulcanization to the tenacity as measured before vulcanization.

(N) Sulfuric acid relative viscosity ($\eta r$)

The relative viscosity is measured at 25° C. on a solution of 2.5 g of a sample in 25 ml of 98% sulfuric acid by using Ostwald viscometer.

Specific examples of the polyamide used in the present invention are polyhexamethylene adipamide and poly-$\epsilon$-caproamide. By the polyhexamethylene adipamide used herein, we mean homopolyamide composed of hexamethylene adipamide units and copolyamide composed of at least 95% by mole of hexamethylene adipamide units and not more than 5% by mole of other copolymerized units. The copolymerized units include, for example, $\epsilon$-caproamide, tetramethylene adipamide, hexamethylene adipamide, hexamethylene isophthalamide, tetramethylene terephthalamide and xylylene phthalamide. If the amount of the copolymerized units in the copolyamide exceeds 5% by mole, the crystallinity of the polyamide fiber is lowered with the results of reduction of heat resistance and thermal dimensional stability.

The polyamide fiber of the present invention is preferably comprised of a polyamide having a sulfuric acid relative viscosity of at least 3.0, more preferably at least 3.5. If the sulfuric acid relative viscosity is lower than 3.0, the intended high-tenacity cannot be stably obtained and the intended excellent tenacity-retention after vulcanization cannot be obtained.

The reasons for which the structural characteristics of the polyamide fiber of the present invention are limited as mentioned above will be described.

The birefringence increases with an enhancement of the molecular orientation in the direction of the fiber axis. The fiber of the present invention is characterized as possessing a high degree of molecular orientation, i.e., having a birefringence of preferably at least $60\times10^{-3}$ and more preferably at least $63\times10^{-3}$. This characteristic is important for attaining a tenacity of at least 11.0 g/d.

One feature of the fiber of the present invention lies in that the birefringence of the surface layer portion is lower than that of the center of the fiber by less than $5\times10^{-3}$. This feature is in striking contrast to the fiber described in Japanese Unexamined Patent Publication No. 3- 241007 wherein the surface layer portion has a higher degree of molecular orientation than that of the center portion. In the case where the surface layer portion has a higher degree of molecular orientation than the center portion, the stress concentration is liable to occur in the surface layer portion and therefore the breaking energy is small. This fiber is not satisfactory as cords. In contrast, in the fiber of the present invention, the molecular orientation in the surface layer portion is mitigated, namely, the fiber is covered with a soft surface layer portion and the breaking energy is large.

Another feature of the fiber of the present invention lies in that the crystal orientation function (fc) is at least 0.88 (the largest crystal function of a completely oriented crystal is 1.0). This crystal orientation function is approximately the same as or larger than those of the conventional high-tenacity polyamide fibers.

A further feature lies in that the amorphous orientation function (fa) is relatively large, i.e., preferably in the range of 0.70 to 0.85. The large amorphous orientation function means that tie molecules tying crystalline molecules exhibit a good orientation. The large amorphous orientation function also serves to attain the high tenacity. The amorphous orientation function should preferably be chosen adequately so that good and balanced tenacity and thermal dimensional stability are obtained.

The long period (Dm) in the direction of the fiber axis is at least 105 angstrom and the long period (De) in the direction perpendicular to the fiber axis is in the range of 90 to 130 angstrom. The long period (Dm) in the direction of the fiber axis is larger than those of the conventional hexamethylene polyamide fibers. This feature is closely related to the fact that the polyhexamethylene adipamide fiber of the present invention is highly oriented and has a high tenacity. The long period (De) in the direction perpendicular to the fiber axis is slightly larger than those of the conventional polyhexamethylene adipamide fibers, but is smaller than that of the fiber described in Japanese Unexamined Patent Publication No. 1-168913. This fact means that the fiber of the present invention has been subjected to hot drawing and heat-treatment at a high temperature, but has not been made by a high-speed spinning method as described in Japanese Unexamined Patent Publication No. 1-168913.

The main dispersion peak temperature ($T\alpha$) in a mechanical loss tangent ($\tan\delta$) curve as obtained by a dynamic viscoelastic measurement is preferably at least 125° C. The conventional polyhexamethylene adipamide fiber as described in Japanese Unexamined Patent Publication No. 1-168913 has a relatively low main dispersion peak temperature, but the fiber of the present invention has a higher main dispersion peak temperature (i.e., at least 125° C.), namely, has a structure such that untied portions are relatively restricted.

The high-tenacity fiber of the present invention is a novel fiber characterized by the above-mentioned structural characteristics (a) through (f). These characteristics (a) through (f) are closely related to each other and it is most preferable that all of these characteristics are satisfied.

The fiber of the present invention usually has a density of not larger than 1.142 g/cm$^3$ preferably in the range of 1,138 to 1.142. This density can be obtained by a direct spinning-drawing process wherein the spinning speed is in the range of 300 to 1,000 m/min, the heat-drawing temperature is in the range of 200° to 250° C. and the contacting time with the hot medium is shorter than 0.2 second. The density of the fiber of the present invention is smaller than that (i.e., at least 1.143 g/cm$^3$) of the fiber described in Japanese Patent Publication No. 3-241007.

The fiber of the present invention satisfying the above-mentioned structural characteristics is made by a direct spinning-drawing process. In this process, it is required that drawing is carried out at a speed of at least 2,000 m/min while a tension of at least 3 g/denier is applied to the fiber and the fiber is placed in contact with a high temperature medium maintained at 230° C. or higher, and therefore, to withstand these severe conditions, a treating agent must be uniformly applied on the fiber surface, which treating agent has a good pressure resistance (i.e., the thin film of an oiling agent present between the running fiber and heat-drawing rollers must be tough), a good lubricating property (i.e., a good lubrication must be maintained between the running fiber and heating rollers) and a good heat resistance (i.e., decomposition of the treating agent on the fiber surface must be prevented so that fuming does not occur and tar-like products are not produced).

The treating agent to be applied on the fiber surface preferably comprises the following components (i), (ii) and (iii):

(i) 50 to 80% by weight of a diester compound, (ii) 0.3 to 10% by weight of a sodium salt of a phosphated product of an ethylene oxide-added (n=1 to 7) branched alcohol having 8 to 26 carbon atoms, and (iii) 10 to 40% by weight of a nonionic surfactant obtained by the reaction of an addition product of ethylene oxide to a polyhydric alcohol (the amount of ethylene oxide is 10 to 50 moles per mole of the polyhydric alcohol), with a monocarboxylic acid and a dicarboxylic acid.

The treating agent must be applied uniformly in an amount of 0.3 to 2.0% by weight based on the weight of the fiber.

As specific examples of the diester compounds, there can be mentioned diesters of a dihydric alcohol such as 1,6-hexanediol, neopentyl glycol or neopentyl glycol oxypivalate with a monobasic acid such as oleic acid, erucic acid, isostearic acid, lauric acid or octylic acid; and an adipic acid ester such as dioleyl adipate, diisostearyl adipate or dioctyl adipate, a sebacic acid ester, and a thiodipropionic acid ester such as dioleyl thiodipropionate or dioctyl thiodipropionate.

As specific examples of the branched alcohol used for the preparation of the sodium salt of a phosphated product of an ethylene oxide-added (n=1 to 7) branched alcohol having 8 to 26 carbon atoms, there can be mentioned 2-ethylhexyl alcohol, 2-nonyltridecanol, 2-undecylpentadecanol and 2-heptylundecanol.

The nonionic surface active agent used is obtained by reacting an addition product of 10 to 50 moles of ethylene oxide to one mole of a polyhydric alcohol, with a monocarboxylic acid and a dicarboxylic acid. As examples of the addition product of ethylene oxide to a polyhydric alcohol, there can be mentioned an addition product of ethylene oxide to hardened castor oil, an addition product of ethylene oxide to sorbitol and an addition product of ethylene oxide to trimethylolpropane. Of these, an ethylene oxide addition product to hardened castor oil and an ethylene oxide addition product to sorbitol are preferable.

The monocarboxylic acid used for preparing the nonionic surface active agent includes, for example, caproic acid, caprylic acid, lauric acid, palmitic acid, stearic acid, oleic acid and isostearic acid. Of these monocarboxylic acids, stearic acid and oleic acid are preferable. The dicarboxylic acid used for preparing the nonionic surface active agent includes, for example, maleic acid, adipic acid, sebacic acid, dodecanoic acid and brassylic acid. Of these dicarboxylic acids, maleic acid and adipic acid are preferable.

The treating agent applied to the fiber of the present invention has a function of imparting a good fiber-making and processing property and, when used as cords for reinforcing rubber, suitably controlling and rendering uniform the penetration of a liquid adhesive such as resorcinol formaldehyde latex (RFL) inside the cords. The uniformity of the liquid adhesive penetrated in the cords can be confirmed by observing the peripheral surface and section of the cord by a scanning electron microscope or an optical microscope. As the result of the observation, it will be seen that a cord of polyamide fibers having applied thereto the above-mentioned treating agent is flexible and has a good adhesion, a high tenacity (both in dip cord and vulcanized cord) and a good fatigue endurance.

The polyamide fiber of the present invention having the above-mentioned structural characteristics has a tenacity of at least 11.0 g/d, usually at least 11.5 g/d, a breaking elongation of at least 16%, usually at least 18%, and a shrinkage in boiling water of not larger than 4.0%.

To stably develop the intended physical properties of the polyamide fiber of the present invention having the above-mentioned structural characteristics, it is important that the fiber contains only an extremely reduced amount of contaminative aggregate particles. If the fiber contains an appreciable amount of contaminative aggregate particles, the fiber is liable to be broken at the sites where the aggregate particles are present, and thus the intended high-tenacity fiber cannot be obtained. Especially, in the case of polyhexamethylene polyamide fibers for industrial use, copper compounds are incorporated in the fibers for imparting thereto heat resistance, light resistance and oxidation resistance and the incorporated copper compounds are partly converted into contaminative aggregate particles causing fiber breakage. Therefore, the amount of the copper-containing contaminative aggregate particles incorporated in the fiber should be smaller than a certain level.

The amount of copper contained in the fiber of the present invention is usually 30 to 150 ppm, preferably 50 to 100 ppm. The contaminative aggregate particles contain copper at a concentration of, for example, at least 50 times of the copper concentration (30 to 150 ppm) in the entire fiber. The concentration of copper in the contaminative aggregate particles are usually several percents. The copper contained in the contaminative aggregate particles is in the form of metal or compounds insoluble in the polymer such as, for example, metallic copper, copper oxides and copper sulfides.

In the present invention, the number of contaminative aggregate particles present in the fiber is no more than 80 per 1.0 mg of the fiber, which aggregate particles contains copper at a concentration of at least 50 times of the copper concentration in the entire fiber and which have a size corresponding to at least 1/10 of the diameter of single fiber as measured in the direction of the fiber axis and a size corresponding to at least 1/25 of the diameter of the fiber as measured in the direction perpendicular to the fiber axis.

The high-tenacity fiber cord of the present invention is comprised of the polyamide fibers having the above-mentioned characteristics and has been primarily twisted and finally twisted at a twist multiplier (K) of 1,500 to 2,300, preferably 1,600 to 2,000. The twist multiplier (K) is calculated from the twist number and the fiber fineness as measured before twisting according to the following equation:

$$K=T\times D^{1/2}$$

where T is twist number per 10 cm and D is (fiber fineness as measured before twisting)×(number of fibers to be combined).

Although the polyamide fiber of the present invention has a tenacity of at least 11.0 g/d, the fiber tenacity is reduced and thus the tenacity of the dipped cord is a considerably low when the dipped cord is made by a conventional process wherein the fibers are combined together and twisted into a cord, an adhesive is applied thereto and the cord is heat-treated to form a dipped cord. Namely, the high tenacity of the fiber is not utilized in the dipped cord.

In the dipping step using a RFL mixed liquid for applying an adhesive to the polyamide fiber cord, where a cord is coated with or dipped in the liquid adhesive, the liquid adhesive penetrates into the cord comprised of a multiplicity of filaments. Then the cord having applied thereto the liquid adhesive is heat-treated at a high temperature close to the melting point of the cord whereby the liquid adhesive inside the cord is converted to a resin adhering together the multiplicity of filaments. The movement of the filaments are restricted by the resin and therefore, when a stress is applied, the stress is not uniformly transmitted over the entire filaments. Thus, filament breakage occurs in the stress-concentrated regions with the result of tenacity reduction of the dipped cord.

Therefore, it is crucial to control and making uniform the penetration of the dipping liquid inside the cord. The dipped cord of the present invention for reinforcing rubber is made by using an adhesive described below and thus the penetration of the adhesive inside the cord can be controlled and made uniform even though the conventional dipping method is employed.

A preferable adhesive is an aqueous adhesive which is prepared by a process wherein a mixture [C] of a compound [A] represented by the following formula (1) and a compound [B] represented by the following formula (2) reacted with formaldehyde [D] in the presence of an alkali catalyst to prepare a condensate [E], and mixing the condensate [E] with a rubber latex [F]. The ratio ([A]/[B]) of the compound [A] to the compound [B] in the mixture [C] is in the range of 1/0.2 to 1/4 by weight. The ratio ([D]/[C]) of formaldehyde [D] to the mixture [C] is in the range of 1/10 to 10/10 by weight, preferably 1.5/10 to 6/10 by weight. The ratio ([E]/[F]) of the condensate [E] to the rubber latex [F] is in the range of 1/8 to 1/4 by weight, preferably 1/7 to 1/5 by weight.

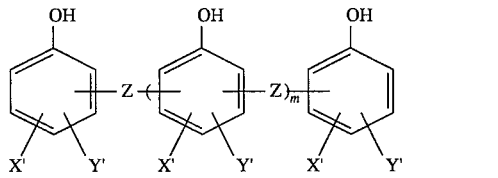

(1)

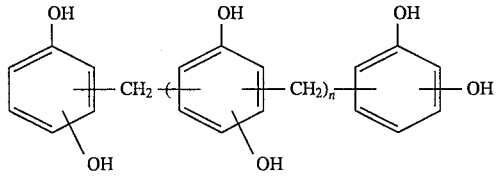

(2)

wherein X' and Y' independently represent —Cl, —Br, —H, —OH, —SH, —$NH_2$, —$NO_2$, an alkyl, aryl or aralkyl group having 1 to 8 carbon atoms, —COOH, —$CONR_1R_2$ (where $R_1$ and $R_2$ independently represent —H or an alkyl, aryl or aralkyl group having 1 to 8 carbon atoms); Z represents —$CR_3R_4$— (where $R_3$ and $R_4$ independently represent —H or an alkyl group having 1 to 8 carbon atoms), —$S_x$— (where S is sulfur atom and x is an integer of 1 to 8) or —$SO_y$— (where S is sulfur atom, O is oxygen atom and y is an integer of 1 or 2), provided that, when Z is —$CR_3R_4$—, at least one of X' and Y' is —Cl and/or —Br; and m and n independently represent 0 or an integer of 1 to 15.

The mixed ratio of compound [A] to compound [B] is voluntarily chosen in the range of:

1/0.2 [A]/[B] (by weight) 1/4, preferably

1/0.2 [A]/[B] (by weight) 1/3.

As specific examples of compound [A], there can be mentioned 2,6-bis(2',4'-dihydroxyphenylmethyl) 4-chlorophenol (commercially available, for example, as tradename "VULCABONDE" supplied by Vulnax Co.), 2,6-bis(2', 4'-dihydroxyphenylmethane)- 4-bromophenol, 2', 6'-bis(2',4'-dichlorophenylmethyl)- 4-chlorophenol and resolcin polysulfide. Compound [A] may be a compound prepared from, for example, a halogenated phenol, formaldehyde, a phenol derivative or a polyhydric phenol, and sulfur chloride (for example, tradename "SUMIKANOL 750" supplied by Sumitomo Chem. Co.). These compounds may be used as a mixture of two or more compounds.

As compound [B], a novolak type resin prepared by reacting dihydroxybenzene with formaldehyde in the absence or presence of an acidic catalyst can be mentioned. Such novolak type resin includes, for example, a condensate made from 1 mole of resorcin and 1 mole or less of formaldehyde (for example, tradename "SUMIKANOL 700" supplied by Sumitomo Chem. Co.). An especially preferable compound [B] is a condensate prepared from 1 mole of dihydroxybenzene and 0.3 to 0.8 mole of formaldehyde in the absence or presence of an acid catalyst and containing tetrahydroxydiphenylmethane as the main ingredient.

As rubber latex [F], there can be mentioned natural rubber latex, synthetic rubber latex and mixtures thereof. The dipped cord which is made by applying the abovementioned adhesive to the polyamide fiber of the present invention having the above-mentioned characteristics is characterized in that the penetration of the adhesive inside the cord is controlled and the adhesive is penetrated uniformly in the peripheral portion of the cord. The state in which the adhesive is penetrated uniformly in the peripheral portion of the cord is confirmed by observing the surface and cross-section of the cord by a scanning electron microscope or an optical microscope. This cord has a feature such that it is flexible as compared with the conventional cords.

A typical example of the process for making the high-tenacity polyamide fiber of the present invention will now be described.

An antioxidant containing a copper compound is incorporated in the fiber of the present invention to impart durability against heat, light, oxygen and others, but part of the copper compound is liable to form contaminative aggregate particles.

When a powdery copper compound is blended with chips of the polyamide, a uniform dispersion is difficult to obtain and the powdery copper compound adsorbed on the chips is liable to fall off. Therefore, the copper compound is unevenly distributed in the fiber, i.e., the fiber has portions containing the copper compound at a high concentration.

To obviate the problems involved in the conventional addition method, the copper compound in a solution form is preferably adsorbed in the polymer by procedures as mentioned below.

A polymer having a sulfuric acid relative viscosity of 2.5 to 3.0 is obtained by a conventional liquid phase polymerization method. The as-produced polymer is cooled and cut into chips. A solution of the copper compound is adsorbed on the chips by immersing the chips in the solution or spraying the solution on the chips, and the copper compound-adsorbed chips are supplied to a solid phase polymerization apparatus where solid phase polymerization is continued until the sulfuric acid relative viscosity reaches at least 3.0.

As specific examples of the copper compound, there can be mentioned cupric acetate, cupric iodide, cupric chloride, cuprous bromide, cupric bromide, copper phthalate, copper stearate, copper phosphate, copper pyrophosphate and other copper salts, and various organic and inorganic copper complex compounds. Since the copper compound is used in a solution form, a water-soluble copper compound is industrially advantageous. A water-insoluble copper compound can be used provided that an aqueous concentrated solution of a halogenated alkali metal is used as a solvent.

Other antioxidants such as, for example, organic and inorganic phosphorus compounds, halides of an alkali metal or an alkaline earth metal, and quaternary ammonium halides may be used in combination with the copper compound. The amount of these antioxidants is about 0.01 to 0.5% by weight. These antioxidants used in combination with the copper compound can be adsorbed in a solution form on polymer chips in the same manner as in the case of the copper compound. Alternatively, a conventional addition method can be employed.

The polymer having adsorbed thereon the copper compound is heated to a temperature of 280° to 310° C. to be thereby melted. The molten polymer is passed through a spinning pack having a nonwoven metal fabric filter with fine holes of a size of about 5 to 50 μm, and extruded through spinneret orifices the as-extruded filaments travel through a hot cylinder having a length of 10 to 100 cm, preferably 15 to 50 cm, which is located immediately beneath the spinneret and the inner atmosphere of which is maintained at a temperature of at least 250° C., preferably 280° to 330° C.

The filaments travelling through the hot cylinder are quenched immediately beneath the hot cylinder, and an oiling agent is applied to the filaments. Then the filaments are taken off at a speed of 300 to 1,000 m/min, preferably 450 to 800 m/min by a take-off roll and are continuously supplied to a drawing step without winding up on a winding-up roll. The take-off speed must be closely related with the conditions in the hot cylinder so that the thus-obtained undrawn filaments have a birefringence of $3\times 10^{-3}$ to $15\times10^{-3}$ preferably $5\times10^{-3}$ to $10\times10^{-3}$.

The oiling agent is applied in an amount corresponding to smaller than ½ of the total amount of the oiling agent. The oiling agent is applied preferably as a low-viscosity solution prepared by using a higher hydrocarbon solvent having 8 to 16 carbon atoms, preferably 10 to 14 carbon atoms.

Further an oiling agent is applied to the filaments taken off by the take-off roll while the filaments are drawn by 1 to 10% of the original length between the take-off roll and a feed roll located immediately downstream from the take-off roll. The oiling agent may be applied either as it is or after it is diluted with a higher hydrocarbon as mentioned above to prepare a low-viscosity solution.

An amount corresponding to smaller than ½, preferably 5 to 30%, of the total amount of the oiling agent is applied to the filaments upstream to the take-off roll, as mentioned above, and the balance of the oiling agent is applied between the take-off roll and the feed roll. The amount of the oiling agent deposited on the fiber is 0.3 to 2.0% by weight, preferably 0.5 to 1.5% by weight, based on the weight of the wound filaments.

In the drawing step, the filaments are drawn by a multi-stage hot drawing method wherein hot drawing is carried out in two or more stages. The drawing ratio employed is at least 90%, preferably 93 to 96% of the possible maximum drawing ratio. By the term "possible maximum drawing ratio" used herein we mean the possible maximum drawing ratio at which filaments are capable of being drawn for 5 minutes without filament breakage.

Total drawing ratio is 3.5 to 6.5 times, usually 4.0 to 6.0 times of the original length. The drawing temperature is such that the final drawing temperature is at least 230° C., preferably in the range of 235° to 250° C.

The drawn filaments are then subjected to a heat relaxation treatment wherein the filaments are relaxed to allow a shrinkage of 8 to 12% between the final drawing roll and a relaxing roll located immediately downstream from the final drawing roll. Substantial part of the heat relaxation is effected on the final drawing roll, and therefore the heat relaxation is carried out at a temperature of at least 230° C., preferably 235° to 250° C.

The filaments are then twisted to give an untreated cord wherein each of a primary twisting and a final twisting is carried out at a twist multiplier of 1,500 to 2,300, preferably 1,600 to 2,000. The untreated cord is supplied to a dipping step either as it is or after it is woven into a cord fabric. In the dipping step an RFL adhesive is applied to the cord. The amount of the adhesive applied to the high-tenacity fiber cord of the present invention is in the range of 1 to 8% by weight, preferably 3 to 6% by weight. The suitable amount of the adhesive varies depending upon the cord constitution, the cord-treating speed, the concentration of dipping liquid, the conditions under which the applied dipping liquid is removed from the cord, and other conditions.

The high-tenacity polyamide fiber of the present invention has the above-mentioned structural characteristics and the above-mentioned physical properties. This fiber has a high tenacity and, when it is embedded in unvulcanized rubber as a reinforcing fiber and the rubber is vulcanized, the reduction of tenacity is very minor, and thus a cord having a high tenacity can be obtained. Where this cord is used as tire reinforcing material, the number of cords used can be reduced or the number of cord fabrics can be reduced. Also a cord comprised of fibers having an extremely small fineness can be used. Thus, the amount of reinforcing fibers in a tire can be reduced, namely, a lightweight tire can be obtained without substantial reduction of the reinforcing performance.

EXAMPLES

Examples 1 to 4 and Comparative Examples 1 to 10

To hexamethylene adipamide, phenylphosphonic acid as a heat stabilizer was added in an amount of 100 ppm as phosphorus, and the mixture was subjected to liquid polymerization to obtain a hexamethylene adipamide polymer having a sulfuric acid relative viscosity of 2.7. The polymer was drawn in a rod-form, cooled with water and then cut into chips having a cylindrical shape with a length of about 3 mm and a diameter of about 3.5 mm.

An aqueous 50% potassium iodide solution and an aqueous 20% potassium bromide solution were applied to the chips whereby 0.1% by weight of potassium iodide and 0.1% by weight of potassium bromide, both based on the weight of the chips, were adsorbed by the chips. Then an aqueous 5% copper acetate solution was applied to the chips whereby 80 ppm, as the amount of copper, of copper acetate was adsorbed on the chips.

The chips were then supplied to a columnar continuous solid polymerization apparatus where solid polymerization was carried out in a nitrogen atmosphere at a temperature of about 150° C. for 22 hours to obtain chips having a sulfuric acid relative viscosity of 3.6. Then the chips were supplied to a humidifier whereby chips having a moisture content of 0.1% by weight were obtained. The chips were supplied to a hopper of an extruder-type spinning apparatus.

The chips were melted at a polymer temperature of 290° C. and passed through a spinning pack having a metal nonwoven fabric filter with fine holes of a diameter of 10 μm, and extruded from a spinneret having orifices with a diameter of 0.3 mm.

The as-extruded filaments were passed through a hot cylinder having a length of 20 cm which is located immediately beneath the spinneret with a heat insulation board of a 3 cm length interposed between the spinneret and the hot cylinder. The temperature of the atmosphere inside the hot cylinder was adjusted to 300° C. by measuring the temperature of a position 10 cm beneath from the upper end of the hot cylinder and at a distance of 1 cm from filaments travelling in the peripheral of the filament bundle. The filaments travelling through the hot cylinder were passed through a uniflow chimney having a length of 20 cm, located beneath the hot cylinder, where the filaments were quenched. In the chimney, a cold air of a temperature of 20° C. was blown against the filaments at a speed of 30 m/min in the direction perpendicular to the filaments.

A low-viscosity mineral oiling agent having the following composition was applied to the cooled filaments, the filaments were taken off at a predetermined speed by a take-off roll and supplied to a hot drawing step.

| Composition of oiling agent: | |
|---|---|
| Diester compound | 75% by weight |
| Sodium salt of phosphated product of ethylene oxide-added branched alcohol | 5% by weight |
| Nonionic surface active agent | 20% by weight |

The hot drawing was carried out in three stages and the succeeding heat relaxation treatment was carried out in one stage. The take-off roll was not heated; a feed roll, a first drawing roll and a second drawing roll were maintained at temperatures of 60° C., 120° C. and 200° C., respectively; and a third drawing roll was maintained at various temperatures exceeding 200° C. The heat relaxation roll was not heated.

A non-aqueous oiling agent comprised of a smoothing agent, an active agent, and minor amounts of high-pressure lubricant, an antistatic agent and an oxidant was applied so that about 1% by weight of the oiling agent was deposited on the filaments, while the filaments were drawn by 5% of the original length between the take-off roll and the feed roll.

Although the total drawing ratio varies depending upon the oriented state of undrawn filaments, it was set at 94% of the possible maximum drawing ratio. The proportion of the drawing ratio in the three drawing stages was 70%, 20% and 10% in the first, second and third drawing stages, respectively. The heat relaxation was carried out under conditions such that the drawn filaments were allowed to shrink by 5 to 12%.

The fiber-making was carried out at various spinning speeds, total drawing ratios and relaxation shrinkages. But, the rate of extrusion of polymer was adjusted so that drawn filaments having a fineness of about 1,260 denier were obtained at various spinning speeds, drawing ratios and relaxation shrinkages.

In comparative examples, (i) fibers made under conditions other than the above-mentioned conditions for making the hightenacity polyamide fibers of the present invention and (ii) a commercially available polyhexamethylene adipamide fiber are described. Further, (iii) a polyhexamethylene adipamide fiber was described as a comparative example, which was obtained by a process wherein all of the above-mentioned antioxidant ingredients such as phenylphosphonic acid, potassium iodide, copper acetate and others were incorporated in the polymerization step, and the solid phase polymerization was carried out to obtain chips and filaments were made from the chips by the same procedures as described above.

Filament-making conditions, and structural characteristics, physical properties and yields of the filaments in examples and comparative examples are shown in Table 1-1 through Table 1-6.

The drawn filaments were primarily twisted at a twist number of 39 per 10 cm to obtain a cord, two of the thus-obtained cord were combined and subjected to final twisting at a twist number of 39 per 10 cm in the direction opposite to that of the primary twist to obtain a greige cord. An adhesive was applied to the greige cord by using a "Computreater" dipping machine supplied by Litzler Co., U.S.A. The adhesive used was a resol-type RFL (resorcin-formalin-latex) liquid. The adhesive concentration and the conditions for removing the adhesive after dipping were adjusted so that about 5% by weight of the adhesive was deposited on the cord.

The dipped cord was then heat-treated. More specifically, the dipped cord was passed through a drying zone where the cord was heated at 160° C. for 120 seconds under conditions such that the cord was kept at the same length, and then the dried cord was passed through a heat-treating zone where the cord was heat-treated at 235° C. for 40 seconds while the cord was drawn so that the tensile stress at the outlet of the heating zone (i.e., tension divided by fineness of the cord) is 1 g/d.

The cord was further heat-treated in a normalizing zone at 230° C. for 40 seconds under relaxed conditions while the cord was allowed to shrink by 1%. The characteristics of the dipped cords as tire cords were evaluated. The results are shown in Tables 2-1, 2-2 and 2-3.

As seen from the above results, the high-tenacity polyamide fiber having the structural characteristics specified in the present invention and containing a reduced amount of contaminative aggregate particles has the intended satisfactory properties and can be made in a good yield. The dipped cord made from the fiber of the present invention provides, when the cord is embedded in rubber and the rubber is vulcanized, a vulcanized product exhibiting a high tenacity and a high elongation (thus a high toughness), an excellent thermal dimensional stability and a good fatigue life. Therefore, the cords are useful as tire cords.

TABLE 1-1

| | Example 1 | Example 2 | Example 3 | Example 4 |
|---|---|---|---|---|
| Method of adding antioxidant | | | | |
| Phenylphosphonic acid | Added at polymerization | Added at polymerization | Added at polymerization | Added at polymerization |
| Copper acetate | Adsorbed on chip | Adsorbed on chip | Adsorbed on chip | Adsorbed on chip |
| Potassium iodide | Adsorbed on chip | Adsorbed on chip | Adsorbed on chip | Adsorbed on chip |
| Potassium bromide | Adsorbed on chip | Adsorbed on chip | Adsorbed on chip | Adsorbed on chip |
| Spinning speed (m/min) | 300 | 400 | 500 | 700 |
| Method of making fiber | Direct spinning-drawing | Direct spinning-drawing | Direct spinning-drawing | Direct spinning-drawing |
| Total drawing ratio (times) | 6.4 | 6.2 | 6.0 | 5.6 |
| Relaxation ratio (%) | 11 | 10 | 10 | 10 |
| Temperature of 2nd drawing roll (°C.) | 200 | 200 | 200 | 200 |
| Temperature of 3rd drawing roll (°C.) | 240 | 240 | 240 | 240 |
| Contact time of 2nd drawing roll (sec) | 0.076 | 0.057 | 0.046 | 0.033 |
| Contact time of 3rd drawing roll (sec) | 0.14 | 0.11 | 0.090 | 0.069 |
| Contact time of relaxation roll (sec) | 0.11 | 0.082 | 0.067 | 0.052 |

TABLE 1-2

| | Example 1 | Example 2 | Example 3 | Example 4 |
|---|---|---|---|---|
| Fineness (D) | 1261 | 1260 | 1263 | 1260 |
| Tenacity (g/d) | 12.5 | 12.2 | 11.8 | 11.2 |
| Breaking elongation (%) | 18.9 | 19.3 | 18.9 | 18.0 |
| Shrinkage in boiling water (%) | 3.6 | 3.4 | 3.2 | 3.2 |
| Relative viscosity in sulfuric acid | 3.82 | 3.75 | 3.74 | 3.74 |
| Birefringence ($\times 10^{-3}$) | 62.8 | 62.6 | 61.6 | 50.9 |
| Differential birefringence ($\times 10^{-3}$) | −1.4 | −1.5 | −0.6 | −0.1 |
| Density (g/cm$^3$) | 1.142 | 1.140 | 1.140 | 1.141 |
| Crystal orientation function | 0.92 | 0.92 | 0.91 | 0.91 |
| Amorphous orientation function | 0.83 | 0.81 | 0.80 | 0.78 |
| Long period along fiber axis (angstrom) | 116 | 114 | 114 | 112 |
| Long period in radius direction (angstrom) | 123 | 120 | 125 | 128 |
| Main dispersion peak temperature (°C.)*1 | 132 | 129 | 129 | 126 |
| No. of contaminative aggregate particles (per 1.0 mg) | 30 | 35 | 39 | 28 |
| Drawability [No. of fiber breakage (per $10^7$m)] | 0.60 | 0.75 | 0.82 | 0.97 |

*1 Main despersion peak temperature in a mechanical loss tangent curve

TABLE 1-3

| | Comparative Example 1 | Comparative Example 2 | Comparative Example 3 | Comparative Example 4 | Comparative Example 5*1 |
|---|---|---|---|---|---|
| Method of adding antioxidant | | | | | |
| Phenylphosphonic acid | Added at polymerization | Added at polymerization | Added at polymerization | Added at polymerization | — |
| Copper acetate | Added at polymerization | Added at polymerization | Added at polymerization | Added at polymerization | — |
| Potassium iodide | Added at polymerization | Added at polymerization | Added at polymerization | Added at polymerization | — |
| Potassium bromide | Added at polymerization | Added at polymerization | Added at polymerization | Added at polymerization | — |
| Spinning speed (m/min) | 500 | 500 | 500 | 2000 | — |
| Method of making fiber | Direct spinning-drawing | Direct spinning-drawing | Separated spinning and drawing*2 | Separated spinning and drawing*2 | — |
| Total drawing ratio (times) | 5.6 | 5.8 | 5.4 | 3.6 | — |
| Relaxation ratio (%) | 10 | 10 | 10 | 10 | — |

TABLE 1-3-continued

| | Comparative Example 1 | Comparative Example 2 | Comparative Example 3 | Comparative Example 4 | Comparative Example 5*1 |
|---|---|---|---|---|---|
| Temperature of 2nd drawing roll (°C.) | 200 | 200 | 200 | 200 | — |
| Temperature of 3rd drawing roll (°C.) | 220 | 220 | 240 | 250 | — |
| Contact time of 2nd drawing roll (sec) | 0.046 | 0.046 | 0.29 | 0.19 | — |
| Contact time of 3rd drawing roll (sec) | 0.096 | 0.093 | 0.41 | 0.41 | — |
| Contact time of relaxation roll (sec) | 0.072 | 0.070 | 0.29 | 0.28 | — |

*1 Commercially available high-tenacity Nylon 66 fiber
*2 Spinning and drawing were carried out in separate steps. The drawing speed was 400 m/min.

TABLE 1-4

| | Comparative Example 1 | Comparative Example 2 | Comparative Example 3 | Comparative Example 4 | Comparative Example 5 |
|---|---|---|---|---|---|
| Fineness (D) | 1262 | 1260 | 1264 | 1261 | 1262 |
| Tenacity (g/d) | 10.8 | 11.2 | 10.5 | 12.0 | 10.5 |
| Breaking elongation (%) | 16.2 | 15.7 | 15.5 | 12.2 | 20.2 |
| Shrinkage in boiling water (%) | 3.5 | 3.9 | 3.5 | 2.0 | 5.2 |
| Relative viscosity in sulfuric acid | 3.72 | 3.72 | 3.76 | 3.70 | 3.72 |
| Birefringence ($\times 10^{-3}$) | 61.0 | 61.5 | 60.8 | 62.8 | 60.3 |
| Differential birefringence ($\times 10^{-3}$) | +1.6 | +1.0 | +2.5 | +4.5 | +1.6 |
| Density (g/cm ) | 1.139 | 1.139 | 1.139 | 1.143 | 1.140 |
| Crystal orientation function | 0.89 | 0.89 | 0.89 | 0.91 | 0.89 |
| Amorphous orientation function | 0.78 | 0.80 | 0.78 | 0.80 | 0.76 |
| Long period along fiber axis (angstrom) | 110 | 112 | 110 | 98 | 106 |
| Long period in radius direction (angstrom) | 122 | 118 | 130 | 160 | 120 |
| Main dispersion peak temperature (°C.)*3 | 126 | 128 | 125 | 117 | 131 |
| No. of contaminative aggregate particles (per 1.0 mg) | 182 | 305 | 265 | 386 | 401 |
| Drawability [No. of fiber breakage (per $10^7$m)] | 2.2 | 20.5 | 5.4 | 30.5 | — |

*3 Main despersion peak temperature in a mechanical loss tangent curve

TABLE 1-5

| | Comparative Example 6 | Comparative Example 7 | Comparative Example 8 | Comparative Example 9 | Comparative Example 10 |
|---|---|---|---|---|---|
| Method of adding antioxidant | | | | | |
| Phenylphosphonic acid | Added at polymerization | Added at polymerization | Added at polymerization | Added at polymerization | Added at polymerization |
| Copper acetate | Added at polymerization | Adsorbed on chip | Added at polymerization | Added at polymerization | Added at polymerization |
| Potassium iodide | Added at polymerization | Adsorbed on chip | Added at polymerization | Added at polymerization | Added at polymerization |
| Potassium bromide | Added at polymerization | Adsorbed on chip | Added at polymerization | Added at polymerization | Added at polymerization |
| Spinning speed (m/min) | 3000 | 500 | 500 | 500 | 2000 |
| Method of making fiber | Direct spinning-drawing | Direct spinning-drawing | Separated spinning and drawing | Separated spinning and drawing | Separated spinning and drawing |
| Total drawing ratio (times) | 2.4 | 6.0 | 5.0 | 5.4 | 3.6 |
| Relaxation ratio (%) | 10 | 10 | 10 | 10 | 10 |
| Temperature of 2nd drawing roll (°C.) | 200 | 200 | 200 | 200 | 200 |
| Temperature of 3rd drawing roll (°C.) | 250 | 220 | 240 | 240 | 240 |
| Contact time of 2nd drawing roll (sec) | 0.007 | 0.046 | 0.29 | 5.8 | 5.8 |
| Contact time of 3rd drawing roll (sec) | 0.006 | 0.090 | 0.41 | 8.2 | 8.2 |
| Contact time of relaxation roll (sec) | 0.007 | 0.067 | 0.29 | 5.8 | 5.8 |

TABLE 1-6

| | Comparative Example 6 | Comparative Example 7 | Comparative Example 8 | Comparative Example 9 | Comparative Example 10 |
|---|---|---|---|---|---|
| Fineness (D) | 1265 | 1267 | 1262 | 1260 | 1259 |
| Tenacity (g/d) | 11.5 | 11.7 | 9.6 | 10.5 | 12.1 |
| Breaking elongation (%) | 16.3 | 18.8 | 17.3 | 15.8 | 11.8 |
| Shrinkage in boiling water (%) | 2.2 | 4.0 | 3.0 | 2.1 | 1.7 |
| Relative viscosity in sulfuric acid | 3.68 | 3.73 | 3.70 | 3.71 | 3.71 |
| Birefringence ($\times 10^{-3}$) | 62.0 | 61.8 | 59.5 | 59.3 | 62.9 |
| Differential birefringence ($\times 10^{-3}$) | +3.4 | +1.5 | +1.5 | −1.4 | −0.1 |
| Density (g/cm ) | 1.144 | 1.141 | 1.138 | 1.139 | 1.144 |
| Crystal orientation function | 0.93 | 0.91 | 0.87 | 0.87 | 0.92 |
| Amorphous orientation function | 0.78 | 0.81 | 0.75 | 0.73 | 0.79 |
| Long period along fiber axis (angstrom) | 105 | 114 | 97 | 97 | 100 |
| Long period in radius direction (angstrom) | 197 | 122 | 128 | 131 | 163 |
| Main dispersion peak temperature (°C.)*1 | 118 | 130 | 124 | 122 | 116 |
| No. of contaminative aggregate particles (per 1.0 mg) | 302 | 32 | 315 | 286 | 294 |
| Drawability [No. of fiber breakage (per $10^7$m)] | 43.5 | 0.85 | 3.5 | 3.1 | 28.6 |

*1 Main despersion peak temperature in a mechanical loss tangent curve

TABLE 2-1

| | Example 1 | Example 2 | Example 3 | Example 4 |
|---|---|---|---|---|
| Dipped cord | | | | |
| Fineness (D) | 2760 | 2755 | 2758 | 2761 |
| Strength (kg) | 28.2 | 27.6 | 27.3 | 27.1 |
| Tenacity (g/d) | 10.2 | 10.0 | 9.9 | 9.8 |
| Breaking elongation (%) | 21.2 | 20.7 | 20.3 | 20.5 |
| Intermediate elongation (%) | 9.0 | 9.0 | 8.9 | 8.9 |
| Dry heat shrinkage (%) | 3.8 | 3.5 | 3.3 | 3.1 |
| Vulcanized Cord | | | | |
| Strength (kg) | 27.1 | 26.5 | 26.2 | 26.0 |
| Breaking elongation (%) | 21.9 | 21.0 | 20.5 | 20.2 |
| Strength retention after vulcanization (%) | 94.6 | 96.0 | 96.1 | 95.9 |
| GY fatigue endurance (min) | 750 | 784 | 840 | 890 |

TABLE 2-2

| | Comparative Example 1 | Comparative Example 2 | Comparative Example 3 | Comparative Example 4 | Comparative Example 5*1 |
|---|---|---|---|---|---|
| Dipped cord | | | | | |
| Fineness (D) | 2760 | 2765 | 2762 | 2758 | 2760 |
| Strength (kg) | 24.8 | 25.3 | 24.3 | 26.0 | 23.7 |
| Tenacity (g/d) | 9.0 | 9.2 | 8.8 | 9.4 | 8.6 |
| Breaking elongation (%) | 19.8 | 19.7 | 18.8 | 19.2 | 21.8 |
| Intermediate elongation (%) | 8.9 | 9.0 | 8.9 | 8.9 | 9.0 |
| Dry heat shrinkage (%) | 3.8 | 3.7 | 3.8 | 3.8 | 3.7 |
| Vulcanized Cord | | | | | |
| Strength (kg) | 23.4 | 23.6 | 23.0 | 25.3 | 22.3 |
| Breaking elongation (%) | 20.5 | 20.6 | 19.8 | 19.5 | 22.0 |
| Strength retention after vulcanization (%) | 94.2 | 93.2 | 94.6 | 97.2 | 94.0 |
| GY fatigue endurance (min) | 670 | 713 | 621 | 1080 | 712 |

*1 Commercially available high-tenacity Nylon 66 fiber

TABLE 2-3

| | Comparative Example 6 | Comparative Example 7 | Comparative Example 8 | Comparative Example 9 | Comparative Example 10 |
|---|---|---|---|---|---|
| Dipped cord | | | | | |
| Fineness (D) | 2767 | 2772 | 2758 | 2765 | 2766 |
| Strength (kg) | 25.7 | 25.8 | 22.3 | 24.6 | 25.7 |
| Tenacity (g/d) | 9.3 | 9.3 | 8.1 | 8.9 | 9.3 |
| Breaking elongation (%) | 20.5 | 20.4 | 19.2 | 18.6 | 19.4 |
| Intermediate elongation (%) | 9.0 | 9.0 | 9.1 | 9.1 | 9.2 |
| Dry heat shrinkage (%) | 2.2 | 3.8 | 3.3 | 3.6 | 3.6 |
| Vulcanized Cord | | | | | |
| Strength (kg) | 25.0 | 24.1 | 21.2 | 23.5 | 25.2 |
| Breaking elongation (%) | 20.8 | 20.6 | 20.5 | 19.8 | 20.2 |
| Strength retention after vulcarization (%) | 97.3 | 93.4 | 95.1 | 95.5 | 98.1 |
| GY fatigue endurance (min) | 1150 | 580 | 782 | 752 | 1096 |

Examples 5 to 7 and Comparative Example 11

Filaments and dipped cords were made by the same procedures as described in Examples 1 and 3 except that an oiling agent was applied as follows. All other conditions in Example 5 remained the same as in Example 1 and all other conditions in Examples 6 and 7 and Comparative Example 11 remained the same as in Example 3. The results are shown Tables 3-1 and 3-2 and Table 4.

Each of the oiling agents having the following composition was diluted with a higher hydrocarbon having 13 carbon atoms to a solution of a 20%by weight concentration. The solution was applied to the filaments, and the filaments were taken by a take-off roll at the predetermined speed. Then the oiling agent having the following composition was applied without dilution to the filaments while the filaments were drawn by 5% between the take-off roll and the feed roll. The total amount of the oiling agent applied was 1.0% by weight based on the weight of the wound filaments. Namely, 0.2% by weight of the oiling agent was applied before the filaments were taken by the take-off roll and 0.8% by weight of the oiling agent was applied between the take-off roll and the feed roll.

| | |
|---|---|
| Oiling agent 1 (Examples 5 and 6): | |
| Neopentyl glycol oxypivalate dioleate | 75 parts |
| Na salt of 2-undecyldecanol $EO_3$ phosphated product | 5 parts |
| Hardened castor oil $EO_{25}$ adipic acid-stearic acid ester | 20 parts |
| Oiling agent 2 (Example 7): | |
| Dioleyl adipate | 75 parts |
| K salt of phosphated product of 2-heptylundecanol $EO_3$ | 5 parts |
| Sorbitol $EO_{40}$ maleic acid-oleic acid ester | 20 parts |
| Oiling agent 3 (Comparative Example 11): | |
| Isooctyl palmitate | 70 parts |
| Na salt of 2-undecyldecanol $EO_3$ phosphated product | 10 parts |
| Higher alcohol EOPO addition product | 20 parts |
| Then the spun filaments were continuously drawn. | |

TABLE 3-1

| | Example 5 | Example 6 | Example 7 | Comparative Example 11 |
|---|---|---|---|---|
| Method of adding antioxidant | | | | |
| Phenylphosphonic acid | Added at polymerization | Added at polymerization | Added at polymerization | Added at polymerization |
| Copper acetate | Adsorbed on chip | Adsorbed on chip | Adsorbed on chip | Adsorbed on chip |
| Potassium iodide | Adsorbed on chip | Adsorbed on chip | Adsorbed on chip | Adsorbed on chip |
| Potassium bromide | Adsorbed on chip | Adsorbed on chip | Adsorbed on chip | Adsorbed on chip |
| Composition of liquid adhesive | adhesive 1 | adhesive 1 | adhesive 2 | adhesive 3 |
| Spinning speed (m/min) | 300 | 500 | 500 | 500 |
| Method of making fiber | Direct spinning-drawing | Direct spinning-drawing | Direct spinning-drawing | Direct spinning-drawing |
| Total drawing ratio (times) | 6.4 | 6.2 | 6.0 | 5.8 |
| Relaxation ratio (%) | 11 | 10 | 10 | 10 |
| Temperature of 2nd drawing roll (°C.) | 200 | 200 | 200 | 200 |
| Temperature of 3rd drawing roll (°C.) | 240 | 240 | 240 | 240 |
| Contact time of 2nd drawing roll (sec) | 0.076 | 0.046 | 0.046 | 0.046 |
| Contact time of 3rd drawing roll (sec) | 0.141 | 0.017 | 0.090 | 0.093 |
| Contact time of relaxation roll (sec) | 0.105 | 0.066 | 0.067 | 0.070 |

TABLE 3-2

| | Example 5 | Example 6 | Example 7 | Comparative Example 11 |
|---|---|---|---|---|
| Fineness (D) | 1263 | 1261 | 1260 | 1261 |
| Tenacity (g/d) | 12.8 | 12.4 | 12.0 | 11.0 |
| Breaking elongation (%) | 19.0 | 19.2 | 18.9 | 17.8 |
| Shrinkage in boiling water (%) | 3.7 | 3.5 | 3.5 | 3.5 |
| Relative viscosity in sulfuric acid | 3.82 | 3.75 | 3.74 | 3.73 |
| Birefringence ($\times 10^{-3}$) | 63.0 | 62.7 | 62.0 | 60.3 |
| Differential birefringence ($\times 10^{-3}$) | −1.7 | −1.2 | −0.4 | +2.0 |
| Density (g/cm ) | 1.141 | 1.141 | 1.140 | 1.139 |
| Crystal orientation function | 0.92 | 0.91 | 0.91 | 0.90 |
| Amorphous orientation function | 0.83 | 0.80 | 0.80 | 0.79 |
| Long period along fiber axis (angstrom) | 118 | 116 | 116 | 114 |
| Long period in radius direction (angstrom) | 123 | 125 | 125 | 124 |
| Main dispersion peak temperature (°C.) | 131 | 129 | 129 | 127 |
| No. of contaminative aggregate particles (per 1.0 mg) | 39 | 31 | 45 | 35 |
| Drawability [No. of fiber breakage (per $10^7$m)] | 0.50 | 0.62 | 0.51 | 1.6 |

TABLE 4

| | Example 5 | Example 6 | Example 7 | Comparative Example 11 |
|---|---|---|---|---|
| Dipped cord | | | | |
| Fineness (D) | 2762 | 2758 | 2760 | 2763 |
| Strength (kg) | 29.3 | 28.6 | 28.1 | 26.0 |
| Tenacity (g/d) | 10.6 | 10.4 | 10.2 | 9.4 |
| Breaking elongation (%) | 21.7 | 20.2 | 20.6 | 20.3 |
| Intermediate elongation (%) | 9.0 | 9.0 | 8.9 | 9.0 |
| Dry heat shrinkage (%) | 3.9 | 3.6 | 3.5 | 3.7 |
| Vulcanized Cord | | | | |
| Strength (kg) | 28.0 | 27.4 | 27.0 | 24.2 |
| Breaking elongation (%) | 21.2 | 20.4 | 20.1 | 20.3 |
| Strength retention after vulcanization (%) | 95.6 | 95.8 | 96.1 | 93.0 |
| GY fatigue endurance (min) | 821 | 876 | 902 | 72.0 |

Examples 8 to 10

Filaments and dipped cords were made by the same procedures as described in Examples 5 and 6 except that an adhesive was applied as follows. All other conditions in Example 8 remained the same as in Example 5 and all other conditions in Examples 9 and 10 remained the same as in Example 6.

As adhesives, a novolak-type RFL liquid and a resol-type RFL liquid were used in the examples. The composition of the adhesives used is shown in Table 5. The concentration of the adhesive liquids and the conditions for removing the adhesives after application of the adhesives were controlled so that the amount of the adhesives deposited on the cord was 5% by weight.

The heat-treatment of the dipped cord was carried out as follows. The dipped cord was passed through a drying zone where the cord was heated at 130° C. for 120 seconds under conditions such that the cord was kept at the same length, and then the dried cord was passed through a heat-treating zone where the cord was heat-treated at 235° C. for 50 seconds while the cord was drawn so that the tensile stress (i.e., tension divided by fineness of the cord) at the outlet of heating zone is 0.8 g/d. The cord was further heat-treated in a normalizing zone at 230° C. for 50 seconds under relaxed conditions while the cord was allowed to shrink by 1%.

The characteristics of the drawn filaments and the dipped cords as tire cord were evaluated. The results are shown in Tables 6-1 and 6-2 and Table 7.

TABLE 5

| | | | Rates (by weight) | | | Amount (parts by weight) | | | | Example |
|---|---|---|---|---|---|---|---|---|---|---|
| | Compound [A] | Compound [B] | [A]/[B] | [D]/[C] | [E]/[F] | [C] | [D] | [E] | [F] | No |
| Liquid adhesive 1 | Vulcabond-E | Sumikanol 700 | 1/1 | 1/10 | 1/5.8 | 26.5 | 2.7 | 29.2 | 167.9 | 8 |
| Liquid adhesive 2 | Sumikanol 750 | Sumikanol 700 | 1/1 | 5/10 | 1/8 | 18.1 | 3.8 | 21.9 | 175.2 | 9 |
| Liquid adhesive 3 | Sumikanol 750 | Sumikanol 700 | 1/1 | 5/10 | 1/5.8 | 22.6 | 6.6 | 29.2 | 167.9 | 10 |

[A] Phenolic compound
[B] Condensate of resorcin with formaldehyde
[C] Mixture of [A] with [B]
[D] Formaldehyde TABLE 5-continued

| Compound [A] | Compound [B] | Rates (by weight) [A]/[B] | [D]/[C] | [E]/[F] | Amount (parts by weight) [C] | [D] | [E] | [F] | Example No |
|---|---|---|---|---|---|---|---|---|---|

[E] Condensate of [C] with [D]
[F] Rubber latex

TABLE 6-1

| | Example 8 | Example 9 | Example 10 |
|---|---|---|---|
| Method of adding antioxidant | | | |
| Phenylphosphonic acid | Added at polymerization | Added at polymerization | Added at polymerization |
| Copper acetate | Adsorbed on chip | Adsorbed on chip | Adsorbed on chip |
| Potassium iodide | Adsorbed on chip | Adsorbed on chip | Adsorbed on chip |
| Potassium bromide | Adsorbed on chip | Adsorbed on chip | Adsorbed on chip |
| Spinning speed (m/min) | 300 | 500 | 500 |
| Method of making fiber | Direct spinning-drawing | Direct spinning-drawing | Direct spinning-drawing |
| Total drawing ratio (times) | 6.4 | 6.2 | 6.0 |
| Relaxation ratio (%) | 11 | 10 | 10 |
| Temperature of 2nd drawing roll (°C.) | 200 | 200 | 200 |
| Temperature of 3rd drawing roll (°C.) | 240 | 240 | 240 |
| Contact time of 2nd drawing roll (sec) | 0.076 | 0.046 | 0.046 |
| Contact time of 3rd drawing roll (sec) | 0.14 | 0.11 | 0.090 |
| Contact time of relaxation roll (sec) | 0.11 | 0.082 | 0.067 |

TABLE 6-2

| | Example 8 | Example 9 | Example 10 |
|---|---|---|---|
| Fineness (D) | 1261 | 1260 | 1263 |
| Tenacity (g/d) | 12.5 | 12.2 | 11.8 |
| Breaking elongation (%) | 18.9 | 19.3 | 18.9 |
| Shrinkage in boiling water (%) | 3.6 | 3.4 | 3.2 |
| Relative viscosity in sulfuric acid | 3.82 | 3.75 | 3.74 |
| Birefringence ($\times 10^{-3}$) | 62.8 | 62.6 | 61.6 |
| Differential birefringence ($\times 10^{-3}$) | −1.4 | −1.5 | −0.6 |
| Density (g/cm ) | 1.142 | 1.140 | 1.140 |
| Crystal orientation function | 0.92 | 0.92 | 0.91 |
| Amorphous orientation function | 0.83 | 0.81 | 0.80 |
| Long period along fiber axis (angstrom) | 116 | 114 | 114 |
| Long period in radius direction (angstrom) | 123 | 120 | 125 |
| Main dispersion peak temperature (°C.) | 132 | 129 | 129 |
| No. of contaminative aggregate particles (per 1.0 mg) | 30 | 35 | 39 |
| Drawability [No. of fiber breakage (per $10^7$m)] | 0.60 | 0.75 | 0.82 |

TABLE 7

| | Example 8 | Example 9 | Example 10 |
|---|---|---|---|
| Dipped cord | | | |
| Fineness (D) | 2767 | 2765 | 2763 |
| Strength (kg) | 28.2 | 29.1 | 29.0 |
| Tenacity (g/d) | 10.2 | 10.5 | 10.5 |
| Breaking elongation (%) | 21.7 | 20.5 | 20.3 |

TABLE 7-continued

| | Example 8 | Example 9 | Example 10 |
|---|---|---|---|
| Intermediate elongation (%) | 9.0 | 8.9 | 9.0 |
| Dry heat shrinkage (%) | 3.5 | 3.5 | 3.6 |
| Vulcanized Cord | | | |
| Strength (kg) | 27.3 | 28.4 | 28.1 |
| Breaking elongation (%) | 21.2 | 20.5 | 20.0 |
| Strength retention after vulcanization (%) | 96.7 | 97.7 | 97.0 |
| GY fatigue endurance (min) | 921 | 876 | 902 |

Industrial Applicability

The high-tenacity polyhexamethylene adipamide fiber and other polyamide fibers of the present invention have a tenacity of at least 11.0 g/d and an elongation of at least 16%, namely, are fibers having a high toughness. The fibers are suitable for various industrial materials. Since the tenacity of these fibers is higher than that of conventional fibers, the fineness of fibers, the number of fibers in the cord and the number of cord fabrics, if used, can be reduced, as compared with the conventional fibers. Thus, the amount of fibers used can be reduced and the product weight can be made lightweight.

Especially, where the fibers are used as a reinforcing material for rubber, the tenacity reduction in the steps of yarn twisting, dipping, vulcanization and others is minor, and thus the tenacity of the reinforcing material can be kept at a high level. Therefore, the rubber product has high performance and high durability. If the amount of the reinforcing material used is reduced because of high tenacity, the production cost and the product weight can be reduced.

A direct spinning-drawing method is employed for making the high-tenacity polyamide fiber of the present invention, and therefore, the production thereof can be commercially advantageously effected with high efficiency and high yield.

The high-tenacity polyamide fiber of the present invention has excellent toughness, adhesion and fatigue endurance, and therefore, is widely used for various industrial materials which include, for example, reinforcing materials for rubber used for tire cords, conveyor belts, transmission belts and rubber hoses; and safety belts, slings, tarpoulin, tents, braids, sewing threads and coated fabrics.

We claim:

1. A high-tenacity polyamide fiber comprised of a polyamide and characterized by satisfying the following requirements (a) through (f):

(a) the differential birefringence $\delta\Delta n$ as defined by the equation $\delta\Delta n=\Delta n_s-\Delta n_c$ is in the range of:

$$=-5\times10^{-3} \text{ to } 0\times10^{-3},$$

wherein $\Delta n_s$ is the birefringence present at a distance of 0.9 of the distance spanning from the center to the surface of the fiber, and $\Delta n_c$ is the birefringence at the center of the fiber, (b) the long period (Dm) in the direction of the fiber axis and the long period (De) in the direction perpendicular to the fiber axis satisfy the following formulae:

$$Dm\geqq105 \text{ angstroms, and } De=90 \text{ to } 130 \text{ angstroms},$$

(c) the main dispersion peak temperature ($T\alpha$) in a mechanical loss tangent ($\tan\delta$) curve as obtained by a dynamic viscoelastic measurement is:

$$T\alpha\geqq125^\circ \text{ C.}$$

(d) the birefringence ($\Delta n$) is:

$$\Delta n\geqq60\times10^{-3},$$

(e) the crystal orientation function (fc) is:

$$fc\geqq0.88,$$

and (f) the amorphous orientation function (fa) is:

$$fa=0.70 \text{ to } 0.85.$$

2. A high-tenacity polyamide fiber as claimed in claim 1, wherein the fiber has a tenacity of at least 11.0 g/d, a breaking elongation of at least 16% and a shrinkage in boiling water is not larger than 4.0%.

3. A high-tenacity polyamide fiber as claimed in claim 1, wherein the fiber has a tenacity of at least 11.0 g/d, a breaking elongation of at least 16% and a shrinkage in boiling water is not larger than 4.0%.

4. A high-tenacity polyamide fiber as claimed in any of claims 1 or claim 2, wherein the polyamide is selected from the group consisting of polyhexamethylene adipamide and poly-ε-caproamide.

5. A high-tenacity polyamide fiber as claimed in claim 4, wherein the polyamide comprises at least 95% by mole of hexamethylene adipamide units and has a sulfuric acid relative viscosity of at least 3.0.

* * * * *